US006098552A

United States Patent [19]

Gunderson

[11] Patent Number: 6,098,552

[45] Date of Patent: Aug. 8, 2000

[54] TEMPORARY WORK SURFACE FOR CONSTRUCTION SITE

[76] Inventor: Douglas C. Gunderson, 203 Minneapolis Ave., Amery, Wis. 54001

[21] Appl. No.: 09/112,110

[22] Filed: Jul. 8, 1998

[51] Int. Cl.[7] ..... A47B 9/00

[52] U.S. Cl. ..... 108/108; 108/152; 211/187; 248/243; 52/736.2; 52/36.4

[58] Field of Search ..... 108/108, 42, 152; 211/90.01, 90.02, 187, 193; 248/243, 245, 295.11; 52/736.2, 36.4

[56] References Cited

U.S. PATENT DOCUMENTS

| | | | |
|---|---|---|---|
| 472,514 | 4/1892 | Sankey . | |
| 595,196 | 12/1897 | Newman et al. . | |
| 1,758,440 | 5/1930 | Goodwin | 248/245 |
| 2,929,121 | 3/1960 | Tinnerman . | |
| 2,984,443 | 5/1961 | Bergengren | 108/152 X |
| 3,428,187 | 2/1969 | Baggott | 248/243 X |
| 3,525,442 | 8/1970 | Novales | 248/243 X |
| 3,710,734 | 1/1973 | Bofferding et al. . | |
| 4,167,255 | 9/1979 | Benson . | |
| 4,442,638 | 4/1984 | Hamilton . | |
| 4,685,576 | 8/1987 | Hobson . | |
| 4,708,309 | 11/1987 | Walter . | |
| 4,717,099 | 1/1988 | Hubbard | 248/295.11 X |
| 4,804,159 | 2/1989 | Martel | 108/152 X |
| 5,303,891 | 4/1994 | Powers . | |
| 5,484,068 | 1/1996 | Huang | 248/245 X |

FOREIGN PATENT DOCUMENTS

| | | | |
|---|---|---|---|
| 652745 | 3/1929 | France | 248/245 |
| 3925302 | 2/1991 | Germany | 108/108 |
| 319435 | 3/1934 | Italy | 248/243 |
| 6508368 | 1/1967 | Netherlands | 108/108 |

*Primary Examiner*—Peter M. Cuomo
*Assistant Examiner*—Hanh V. Tran
*Attorney, Agent, or Firm*—Ryan Kromholz & Manion,S.C

[57] ABSTRACT

A support system for a temporary work surface is provided which is adapted for attachment to a plurality of wall studs at a construction site. A support assembly includes a plurality, usually two, elongated arms adapted for removable cantilevered attachment to exposed vertical wall studs. A generally C-shaped mounting bracket for each elongated arm is adapted for frictional engagement with a wall stud. If desired the bracket may be mounted at a selected vertical location on a stud using common mechanical fasteners. The free ends of the supporting arms have protrusions adapted to retain a work surface, such as a plywood sheet on the support arms. Preferably a notch on the lower surface of each arm engages the clamp in order to fix the position of the arm relative to the supporting wall stud. The notch also provides for an incline of the supporting arm downwardly away from the supporting stud, thus providing a corresponding incline to the supported work surface.

8 Claims, 1 Drawing Sheet

TEMPORARY WORK SURFACE FOR CONSTRUCTION SITE

The present invention relates to devices for supporting work surfaces. More particularly the invention relates to such devices for temporary work surfaces usable at building construction sites.

BACKGROUND OF THE INVENTION

Building construction sites generally lack work surfaces such as counter tops, tables, etc. which can be used for laying out documents such as building blueprints, or to lay out components of an item which needs to be assembled. Often the only available surfaces are plywood sheets or boards placed over saw horses or on make-shift supports. This is generally inconvenient due to the need for workers to use the saw horses for other purposes. A need has thus existed for improved devices for providing a temporary work surface usable for the above noted and related purposes.

SUMMARY OF THE INVENTION

A principal object of the present invention is to provide an economical, easy to install and use temporary work surface system having particular applicability at construction sites. A related object is to utilize building studs which are generally available at construction sites as vertical supports upon which the temporary work surface of the present invention can be removably attached.

A further aspect of the invention relates to the provision of supporting arms for supporting a work surface such as a sheet of plywood, which arms are adapted to be mounted on vertical building studs in cantilevered fashion. Additional aspects of the invention relates to provision on each of the support arms of upwardly extending protrusions adapted to retain a sheet of material which provides a flat work surface, such as plywood, on the cantilevered arms.

In accordance with a further aspect, the arms are provided with clamp engaging notches which fix the position of the arms relative to the stud engaging clamps, and thus, relative to the studs, themselves. A further advantage of this aspect is that the work surface is inclined slightly, adding to comfort and improved viewability of materials supported on the surface.

A further aspect of the invention relates to provision of a supporting assembly for a work surface which can be readily stored or transported in a compactly assembled or position mode. Another related aspect is the ability to quickly install the assembly for use at a building site using commonly available tools and materials.

Briefly, a support system for a temporary work surface is provided pursuant to this invention which is adapted for attachment to a plurality of wall studs at a construction site. A support assembly includes a plurality, usually two, elongated arms adapted for removable cantilevered attachment to exposed vertical wall studs. A generally C-shaped mounting bracket for each elongated arm is adapted for engagement with a wall stud to support each arm. The bracket is mounted at a selected vertical location on a stud using common mechanical fasteners such as nails or screws. The free ends of the supporting arms have protrusions adapted to retain a work surface, such as a plywood sheet on the supporting arms. Preferably a notch on the lower surface of each arm engages the clamp in order to fix the position of the arm relative to the supporting wall stud. The notch also provides for an incline of the supporting arm downwardly away from the supporting stud, thus providing a corresponding incline to the supported work surface.

DETAILED DESCRIPTION OF THE INVENTION

Figure 1:
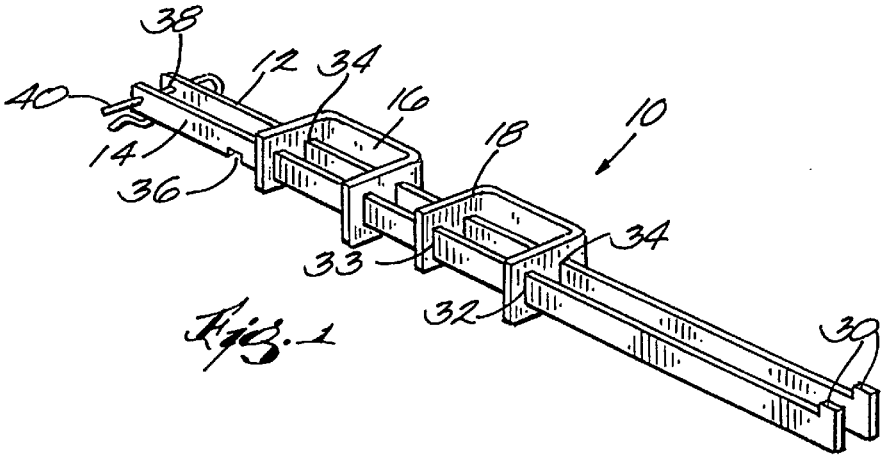
FIG. 1 is a perspective view of a work surface device of this invention assembled for storage or transportation.

Referring more particularly to the drawings there is seen in FIG. 1 an assembly 10 showing the support components of this invention. Assembly 10 includes a pair of elongated metal arms 12 and 14. A pair of mounting brackets 16 and 18 are provided for attachment of the arms 12 and 14 to conventional building studs 20 and 22, commonly referred to as "2×4's".

Figure 2:
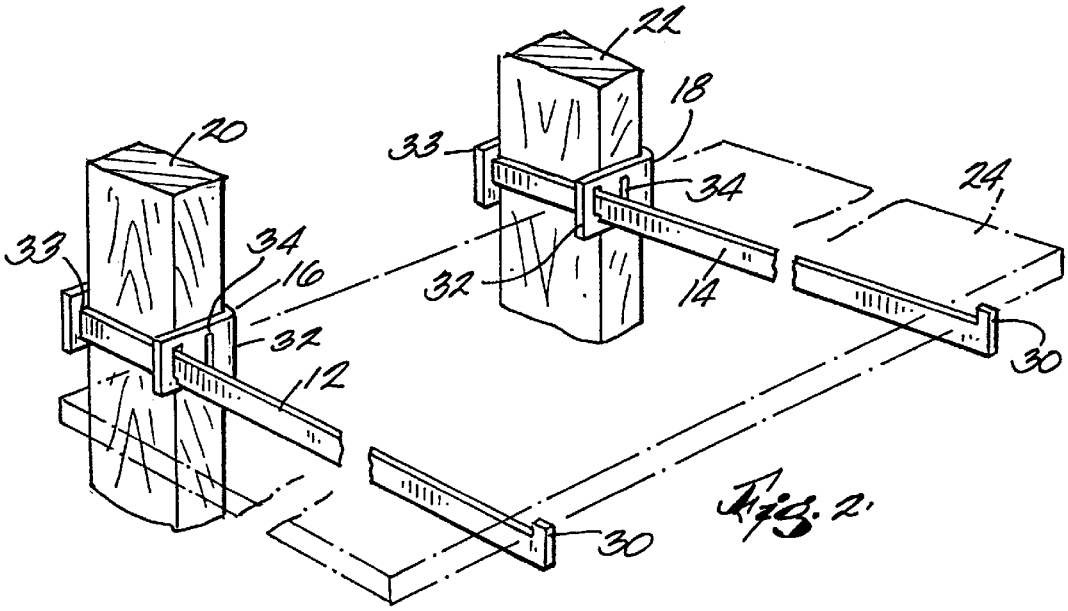
FIG. 2 is a fragmentary perspective view of the device of FIG. 1 mounted on a pair of building studs with a work surface illustrated by phantom lines.

When assembled as shown in FIG. 2 the support arms 12 and 14 serve to support a flat surfaced member 24 suitable for use as a work surface suitable, for example, for writing, reading blueprints, etc. Flat surfaced member 24 can be a sheet of plywood but other materials such as plastic sheet materials, plexiglass, etc. can be used instead as desired. The free end of each of the arms 12 and 14 is provided with an upwardly extending protrusion 30 which serves to retain the flat surfaced member 24 on the arms.

Each of the clamps 16 and 18 is provided with a pair of aligned openings 32 having a cross section adapted to receive the arms 12 and 14. A second series of aligned openings 34 through each of the brackets provides a convenient means for assembling the pair of arms for storage or transport in the position shown in FIG. 1. For this purpose another opening 38 at the end of each of the arms 12 and 14 is provided to enable the temporary securement of the arms in the position shown in FIG. 1 by means of a pin such as a cotter pin 40.

Figure 3:
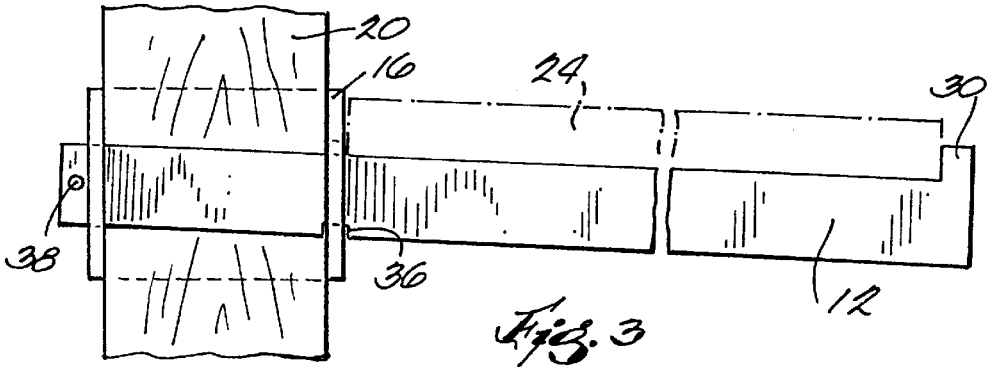
FIG. 3 is a side view of the assembly shown in FIG. 2.

Each of the arms 12 and 14 is also provided with a notch 36 on its lower surface sized and adapted for engagement with the bottom perimeter of opening 32. Notch 36 serves to locate the arm in a proper desired position relative to the studs 20 and 22. The notch 36 also provides a slight incline to the work surface 24 as best seen in FIG. 3. This incline enhances the usability of the work surface provided by top of sheet material 24.

In use it will be apparent that each of the arms can easily be mounted in cantilevered fashion on one of the studs 20 and 22. In most cases the weight of the sheet material 24 will cause sufficient twisting of the clamps 16 and 18 into the wood of the stud 20 or 22 so that the clamp-arm combination remains positioned at a desired height on the stud without a need for use of a mechanical fastener. However, if desired in particular locations, the clamp-arm combination may be fixed at a selected vertical height using a nail or screw through one of the openings 34. Such fastener can be installed only partly into the stud to enable easy removal when desired.

While it is contemplated that the supporting assembly shown in FIG. 1 be made out of a metal such as steel, it will be apparent that other materials such as molded plastics, fiber glass reinforced plastics, or similar materials can be substituted for any or all of these components, if desired.

While the specific embodiments described above are given for purposes of illustration, it will be apparent to those skilled in the art that various other modifications may be made within the true scope and spirit of the invention. The invention should therefore be deemed to be limited only by the appended claims including the equivalents thereof.

What is claimed is:

1. A support system for a temporary work surface adapted for attachment to a plurality of wall studs at a construction site comprising:

a plurality of elongated linear arms adapted for removable cantilevered attachment to exposed vertical wall studs, with said arms extending outwardly from first sides of said studs, an associated mounting bracket for each such elongated linear arm, each bracket being adapted for engagement with a wall stud, each said bracket having a generally C-shaped configuration adapted to contain said stud on at least three sides, each said C-shaped configuration including a first side and a second side adapted to engage, respectively, said first side and an opposed second side of a selected wall stud, said first and second sides each having a number of aligned openings therein, said arms each extending outwardly from said first side of its associated bracket whereby, due to the force of gravity, twisting of said brackets against said studs releasably fixes said brackets at a selected vertical location on said stud.

2. A support system according to claim 1 wherein said arms each have a free end and a second end engaging said bracket, said free ends having protrusions adapted to retain a sheet of rigid material which provides said temporary work surface on said arms.

3. A support system according to claim 1 wherein a first pair of said aligned openings each sized to receive one of said elongated arms, said openings being spaced away from an opposite closed side of said C-shaped bracket a distance adapted to enable said arm and said bracket to enclose one of said vertical wall studs.

4. A support system according to claim 2 wherein said second end is slidably received in an opening in said bracket.

5. A support system according to claim 1 wherein a notch is provided on a lower surface of each arm for engaging the first side of its associated bracket in order to fix the position of the arm relative to a supporting wall stud, and providing an incline of the supporting arm downwardly away from the supporting stud, thus providing a corresponding incline to a supported work surface.

6. In combination, a sheet of rigid flat material having a flat planar surface adapted for use as a temporary work surface for temporary attachment to a plurality of wall studs at a construction site, a pair of elongated arms each adapted for removable cantilevered attachment to a mounting bracket on an exposed vertical wall stud, a free end of each of said arms each being provided with an upwardly extending protrusion adapted for retaining said sheet on said arms, a pair of mounting brackets for said elongated arms, each bracket being adapted for engagement with a wall stud, each said bracket having a generally C-shaped configuration adapted to confine said stud on at least three sides, said C-shaped configuration including first and second sides adapted to engage first and second opposite sides of a wall stud, whereby twisting of said brackets against said studs releasably fixes said brackets at a selected vertical location on said stud.

7. A combination according to claim 6 wherein a first pair of said aligned openings sized to slidably receive a second end of one of said elongated arms, and being spaced away from an opposite closed side of said C-shaped bracket a distance adapted to enable said arm and said bracket to encircle one of said vertical wall studs.

8. A support system according to claim 7 wherein a notch is provided on a lower surface of each arm for engaging the bracket in order to fix the position of the arm relative to the supporting wall stud, and for providing an incline of the supporting arm downwardly away from a supporting stud, thus providing a corresponding incline to said supported work surface.

* * * * *